US005313739A

United States Patent [19]

Nelson et al.

[11] Patent Number: 5,313,739

[45] Date of Patent: May 24, 1994

[54] SLIDING DOOR CLOSURE SYSTEM

[76] Inventors: Nancy K. Nelson; Dennis H. Nelson, both of 1834 S. Peach St., Meford, Oreg. 97501

[21] Appl. No.: 44,655

[22] Filed: Apr. 12, 1993

[51] Int. Cl.[5] ..... E05D 15/06

[52] U.S. Cl. ..... 49/404; 49/386; 16/72

[58] Field of Search ..... 49/404, 386, 445, 446; 16/78, 72, 197, DIG. 36, DIG. 10

[56] References Cited

U.S. PATENT DOCUMENTS 3,026,560 3/1962 Starck ..... 49/445 X
4,003,102 1/1977 Hawks et al. ..... 49/404 X
4,301,623 11/1981 Demukai ..... 49/404
4,471,575 9/1984 Stout .
4,649,598 3/1987 Kinsey et al. .
4,884,369 12/1989 Tatham .
4,891,911 1/1990 Yung .
5,131,188 7/1992 Hutchison et al. .

*Primary Examiner*—Philip C. Kannan
*Attorney, Agent, or Firm*—Henderson & Sturm

[57] ABSTRACT

A sliding door closure system (10) for a sliding door assembly (100) including a door frame (101) enclosing a pair of sliding doors (102) wherein the system (10) comprises a telescoping housing unit (13) operatively associated with an internal spring biasing unit (14) wherein one end of the housing unit (13) is operatively associated with the door frame (101) and the other end of the housing unit is operatively associated with one of the sliding doors (102); and, further including tension adjustment means (15) for fictionally adjusting the closure speed of the housing unit (13).

5 Claims, 2 Drawing Sheets

SLIDING DOOR CLOSURE SYSTEM

TECHNICAL FIELD

The present invention relates to the field of sliding door closure system in general; and in particular, to an exteriorly mounted add-on closure system for existing sliding door constructions.

BACKGROUND ART

As can be seen by reference to the following U.S. Pat. Nos. 5,131,188; 4,649,598; 4,891,911; 4,471,575; and 4,884,369; the prior art is replete with myriad and diverse self-contained automatic sliding door closure arrangements.

While all of the aforementioned prior art constructions are more than adequate for the basic purpose and function for which they have been specifically designed, these patented devices are of little or no value to owners of sliding glass door constructions that are not equipped with these self-contained door closure arrangements.

Needless to say, the vast majority of both existing and planned future construction will not be equipped with the self-contained closure systems due to their initial cost coupled with the degree of difficulty encountered in repairing and/or replacing the self-contained internal door mechanisms.

As a consequence of the foregoing situation, there has existed a longstanding need among owners of sliding glass door constructions for a simple and efficient add-on closure arrangement that can be installed on the exterior surfaces of the sliding glass doors to produce a self-closing effect; and, the provision of such a construction is a stated objective of the present invention.

DISCLOSURE OF THE INVENTION

Briefly stated, the sliding door closure system that forms the basis of the present invention comprises in general; a support unit; an attachment unit; a telescoping housing unit; a spring biasing unit; and a tension adjustment unit.

The main feature of novelty of the sliding door closure system of this invention revolves around the fact that the system itself is an externally mounted add-on system which may be quickly and easily installed, repaired or replaced on an existing sliding door assembly, coupled with the fact that the system per se employs a rather unique spring biasing unit as well as a tension adjustment unit.

As will be explained in greater detail further on in the specification, the sliding door closure system allows the user to select how fast or slow the sliding door closure system will operate to effect the closure of the sliding door such as relatively fast during the extreme weather conditions encountered in the middle of winter and summer, and relatively slow during the more moderate seasons of spring and fall.

In addition, the sliding door closure system of this invention can be employed as a door stop mechanism to retain the sliding door in a fully opened, fully closed or partially open disposition according to the needs of the user.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
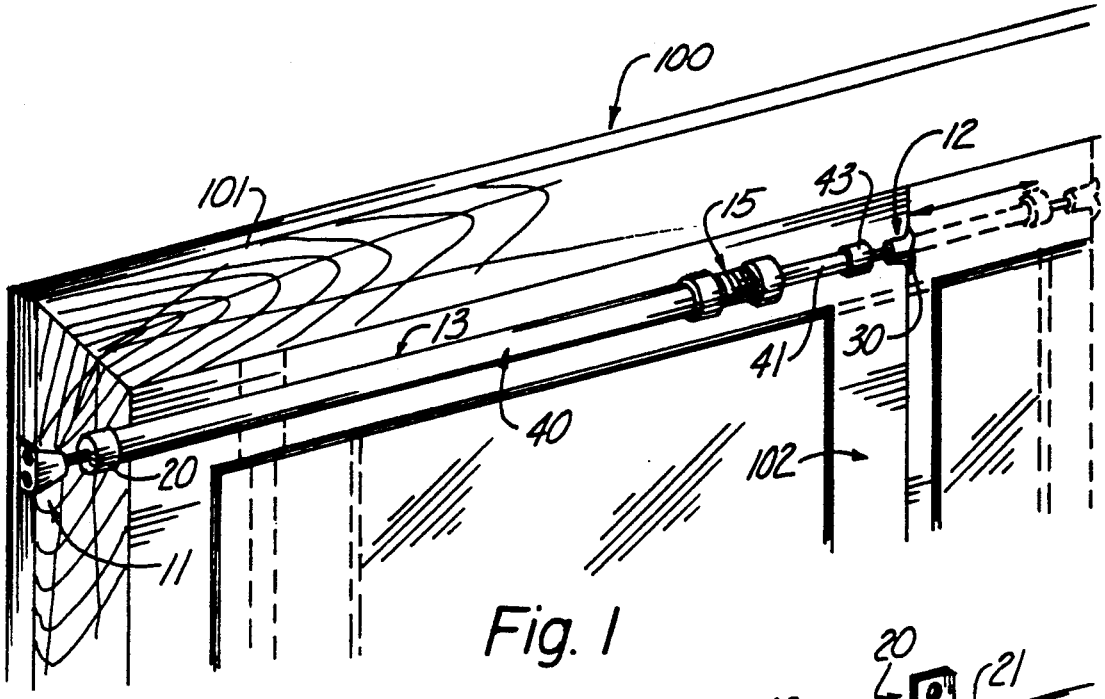
FIG. 1 is a perspective view of the sliding door closure system installed on a conventional sliding glass door assembly.
Figure 4:
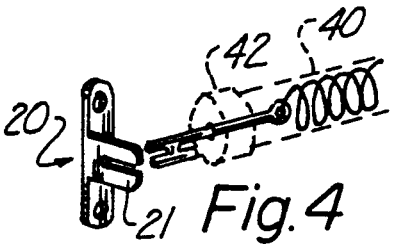
FIG. 4 is a perspective view of one version of the anchor unit.
Figure 5:
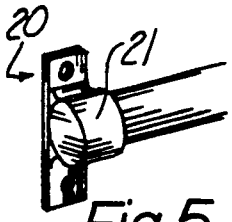
FIG. 5 is a perspective view of another version of the anchor unit.

As can be seen by reference to the drawings, and in particular to FIG. 1, the sliding door closure system that forms the basis of the present invention is designated generally by the reference numeral (10). As shown in FIGS. 1 through 8, the system (10) comprises in general a support unit (11); an attachment unit (12); a telescoping housing unit (13); a spring biasing unit (14) and a tension adjustment unit (15). These units will now be described in seriatim fashion.

Figure 7:
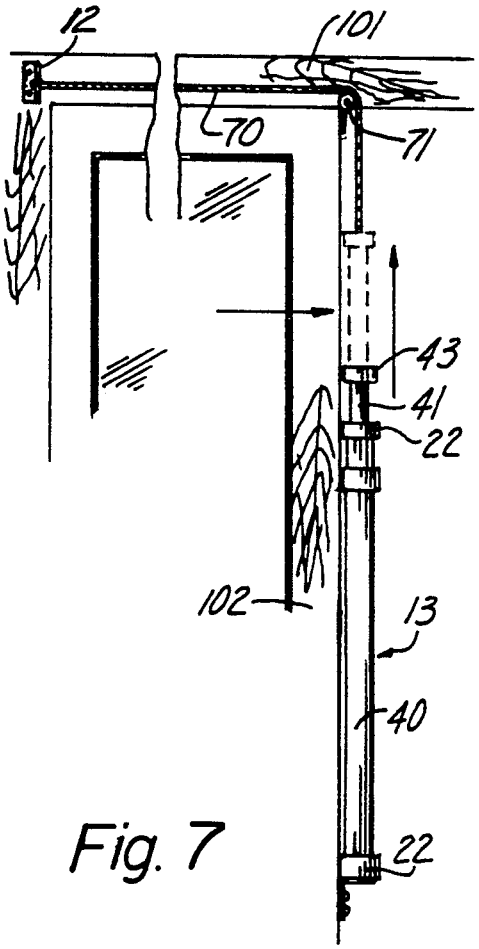
FIG. 7 is a front view of one mounting arrangement of the door closure system.
Figure 8:
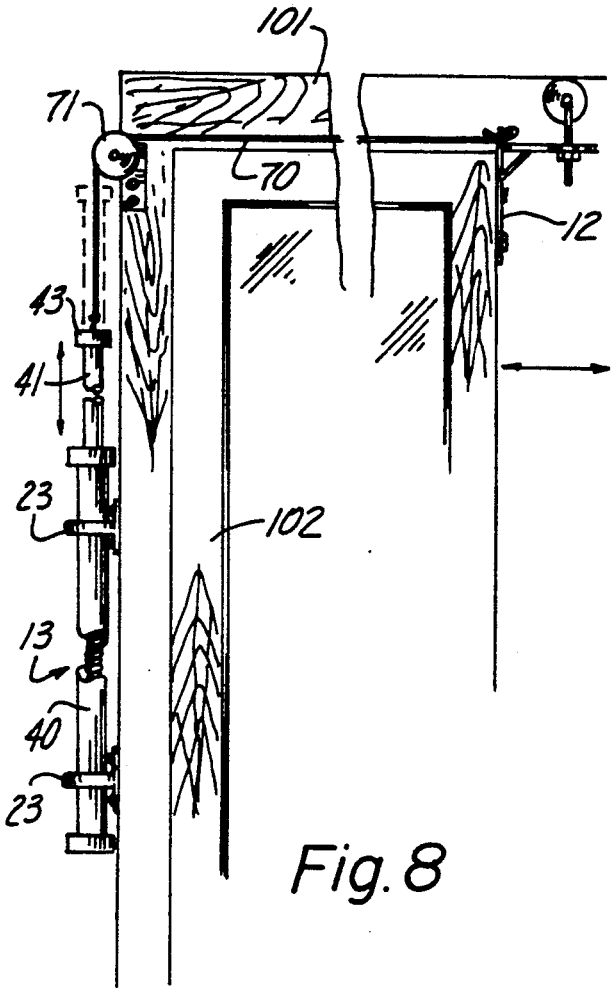
FIG. 8 is a front plan view of another mounting arrangement of the door closure system.

As can be seen by reference to FIGS. 1, 7 and 8, the sliding door closure system (10) may be attached to the frame (101) and an exterior door surface (102) of a sliding glass door assembly (100) in a variety of ways; and, for the purposes of explanation, the support unit (11) will always refer to the primary support structure for the larger end of the telescoping housing unit (13) while the attachment unit (12) will always refer to the attachment structure operatively associated with the smaller end of the telescoping housing unit (13).

In the horizontally disposed orientation of the sliding door closure system (10) illustrated in FIGS. 1, 2, 4 and 5, it can be seen that the support unit (11) comprises a bracket member (20) mounted on the door frame (101) of a door assembly (100); wherein, the bracket member (20) has an outwardly projecting portion (21) which is operatively associated with the larger end of the telescoping housing unit (13); and, wherein, the attachment unit (12) comprises a capture arm member (30) affixed to one side of a sliding door (102) and operatively associated with the smaller end of the telescoping housing unit (13).

Figure 2:
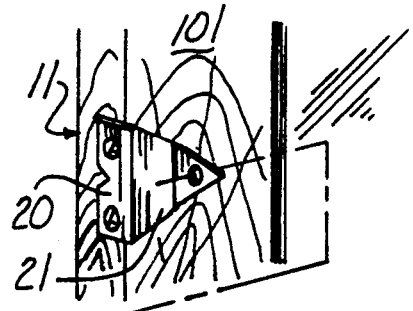
FIG. 2 is an exploded perspective view of the sliding door closure system.
Figure 2:
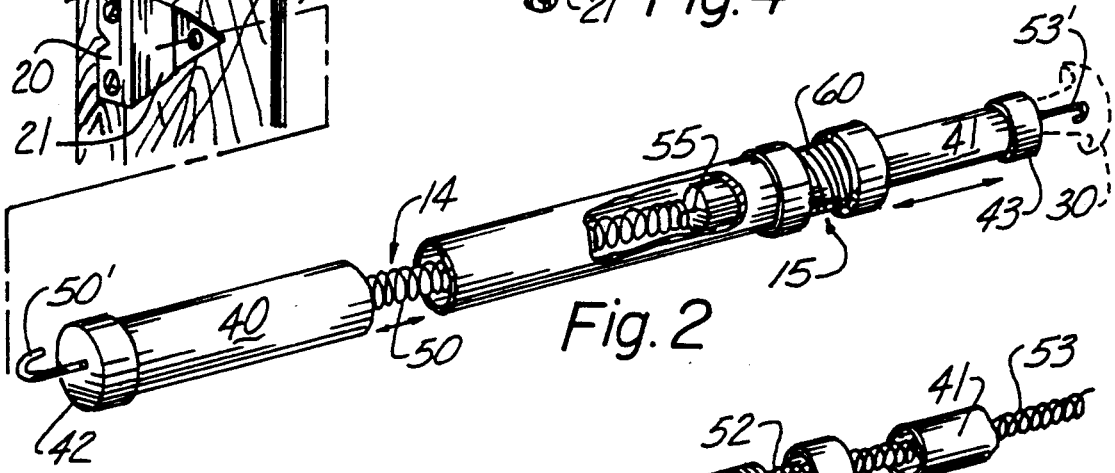
Figure 3:
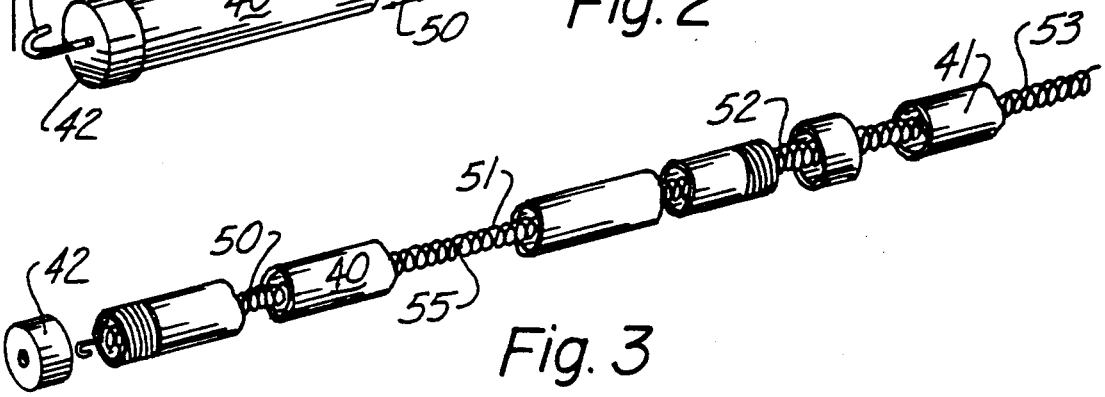
FIG. 3 is a partial cut-away view of the telescoping housing unit and the spring biasing unit.
Figure 6:
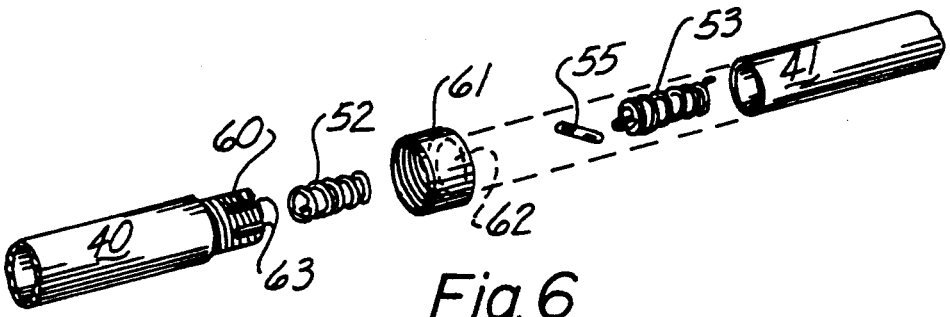
FIG. 6 is an exploded perspective view of the spring biasing and tension adjustment unit.

As can best be seen by reference to FIGS. 2, 3 and 6, the telescoping housing unit (13) comprises an enlarged generally elongated outer cylindrical housing member (40) and a reduced diameter generally elongated inner cylindrical housing member (41) which is telescopically received in one end of the outer housing member (40).

In addition, the other end of the outer housing member (40) is further provided with an end cap element (42) which is operatively associated with both one end of the spring biasing unit (14) and the bracket member (20) for supporting one end of the housing unit (13) in a generally horizontal disposition; wherein, the other end of the inner housing member (41) is also provided with an end cap element (43) which is operatively associated with both the other end of the spring biasing unit (14) and the capture arm member (30) for supporting the other end of the housing unit (13) in a generally horizontal disposition.

As can also be seen by reference to FIGS. 2, 3 and 6, the spring biasing unit (14) comprises a plurality of helical spring biasing members (50)(51)(52)(53); wherein, the spring biasing members (50)(51)(52) and (53) are connected on their adjacent ends by spring connector elements (55).

It should further be noted at this juncture that a plurality of spring biasing members (50)(51)(52) and (53) are employed due to the fact that experimentation has proven that a single elongated helical spring experiences "accordion slack" after a relatively short period of time; wherein, the center section of an elongated helical spring becomes overstretched and this loses its resilient characteristics.

As can best be seen by reference to FIG. 2, the free ends of both the first (50) and last (53) helical spring members in the linked spring chain are provided with connectors (50)(53) which are operatively associated with both the end cap elements (42)(43) of the housing members (40)(41) to bias the inner housing member (41) into a telescopically closed position relative to the outer housing member (40).

Returning once more to FIGS. 2, 3, and 6, it can be seen that the tension adjustment unit (15) comprises a threaded and slotted reduced diameter extension element (60) formed on the end of the outer housing member (40) which slideably receives the inner housing member (41), and an internally threaded adjustment collar (61) having a reduced diameter opening (62) dimensioned to slideably receive the inner housing member (41).

As the adjustment collar (61) threadedly engages the extension element (60) of the outer housing member (40) the slots (63) of the extension element (60) are compressed to vary the frictional resistance of the extension element (60) against the sides of the inner housing member (41) to resist the passage of the inner housing member (41) relative to the outer housing member (40).

In the alternate versions of the preferred embodiment depicted in FIGS. 7 and 8, it can be seen that the housing unit (13) is disposed in a vertical orientation relative to both the door frame (101) and the sliding doors (102); wherein, in the version depicted in FIG. 7, the housing unit (13) is attached to the outside surface of one of the doors (102) via a plurality of brackets (22); and, in the version of FIG. 8 the housing unit (13) is attached to the outside surface of the door frame (101) by a similar bracket arrangement.

In both of these alternate versions of the preferred embodiment, an elongated tether (70) is operatively attached on one end to the end caps (43) of the inner housing member (41) and on the other end to the attachment unit (12); wherein, the intermediate portion of the tether (70) passes over a roller bearing bracket (71) which is mounted on the same substrate that supports the housing unit (13).

By now it should be appreciated that once the door closure system (10) is installed on the exterior of an existing sliding door assembly (100), the user may vary the closure speed of the sliding door (102) by manipulating the adjustment collar (61) to increase or decrease the frictional resistance of the reduced diameter extension element (60) on the outer housing member (40) relative to the inner housing member (41).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A sliding door closure system for a sliding door assembly, including a pair of sliding doors mounted within a door frame; wherein, the closure system comprises:

a telescoping housing unit, including an inner housing member and an outer housing member relatively movable with respect to one another wherein one end of the housing unit is operatively associated with the door frame and the other end of the housing unit is operatively associated with one of said sliding doors; and a spring biasing unit, including a plurality of helical spring members connected in an end to end fashion wherein the front end of the first of said plurality of spring members is operatively attached to the outer housing member and the rear end of the last of said plurality of spring members is operatively attached to the inner housing member.

2. The closure system as in claim 1 further comprising tension adjustment means for fictionally resisting the speed of travel of the inner housing member relative to the outer housing member.

3. The closure system as in claim 2; wherein, the tension adjustment means comprises a threaded and slotted reduced diameter extension element formed on one end of the outer housing element wherein the extension element is dimensioned to receive the inner housing member; and, a threaded adjustment collar engageable with the extension element to bring the extension element into frictional engagement with the sides of the inner housing member.

4. The closure system as in claim 3; wherein, the housing unit is supported in a horizontal disposition relative to the sliding door assembly.

5. The closure system as in claim 3; wherein, the housing unit is supported in a vertical disposition relative to the sliding door assembly.

* * * * *